US006217392B1

(12) United States Patent
Chen

(10) Patent No.: US 6,217,392 B1
(45) Date of Patent: Apr. 17, 2001

(54) ELECTRICAL CONNECTOR

(75) Inventor: Chien Cheng Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/527,347

(22) Filed: Mar. 17, 2000

(30) Foreign Application Priority Data

Dec. 17, 1999 (TW) ..... 088221560

(51) Int. Cl.[7] ..... H01R 24/00
(52) U.S. Cl. ..... 439/676; 439/941
(58) Field of Search ..... 439/676, 941, 439/344, 607

(56) References Cited

U.S. PATENT DOCUMENTS 5,647,770 * 7/1997 Beloposky ..... 439/676
5,971,813 * 10/1999 Kunz et al. ..... 439/676
6,017,247 * 1/2000 Gwiazdowski ..... 439/676

* cited by examiner

*Primary Examiner*—Khiem Nguyen
*Assistant Examiner*—Son V. Nguyen
(74) *Attorney, Agent, or Firm*—Wei Te Chung

(57) ABSTRACT

An electrical connector comprises an insulative housing defining a receiving apace therein. Eight terminals labeled from one to eight are assembled in the receiving space. Each terminal includes a contacting portion at one end for engaging with a mating connector, a solder tail at an opposite end for soldering to a printed circuit board, and a curving portion extending between the contacting portion and the solder tail. Every two adjacent solder tails are separated by a second distance N2 which is larger than a first distance N1 separating every two adjacent contacting portions. At least one of three adjacent solder tails of the terminals protrudes beyond a plane defined by other solder tails. In particular, a distance between a third and fourth terminals, and a fifth and sixth terminals, is increased, thereby diminishing cross-talk therebetween.

3 Claims, 7 Drawing Sheets

ELECTRICAL CONNECTOR

BACKGROUND OF THE INVENTION

The present invention relates to an electrical connector, and particularly to a modular jack electrical connector.

FIGS. 7 and 8 disclose a plurality of prior terminals 8 for a modular jack electrical connector. Each terminal 8 includes a contacting portion 81 at one end for contacting with a mating connector, a solder tail 82 at an opposite end for soldering to a printed circuit board, and a connecting portion extending between the contacting portion 81 and the solder tail 82. Each two adjacent solder tails 82 are separated by a second distance N2 which is larger than a first distance N1 separating each two adjacent contacting portions 81, thereby decreasing cross-talk between the two adjacent solder tails 82. However, in use, the cross-talk between adjacent solder tails 82 of the terminals 8 still exists, especially between a third solder tail 823 and a fourth solder tail 824, and a fifth solder tail 825 and a sixth solder tail 826.

Hence, an improved terminal for a modular jack electrical connector is required to overcome the disadvantages of the prior art.

BRIEF SUMMARY OF THE INVENTION

An object of the present invention is to provide an electrical connector wherein terminals assembled in the electrical connector are provided with bended portions having an increased distance therebetween, thereby diminishing cross-talk therebetween.

To fulfill the above mentioned objective, an electrical connector in accordance with the present invention comprises an insulative housing defining a receiving space therein. Eight terminals labeled from one to eight are assembled in the receiving space. Each terminal includes a contacting portion at one end for engaging with a mating connector, a solder tail at an opposite end for soldering to a printed circuit board, and a curving portion extending between the contacting portion and the solder tail. Each two adjacent solder tails are separated by a second distance N2 which is larger than a first distance N1 separating every two adjacent contacting portions. At least one of three adjacent solder tails of the terminals protrudes beyond a plane defined by the other solder tails.

In accordance with the above features, a third and a sixth terminals protrude beyond the plane; a first, a second, a seventh, and an eighth terminals extend laterally within the plane; and a fourth and a fifth terminal diverge within the plane to increase a distance between a third and the fourth terminals, the fifth and the sixth terminal.

Other objects, advantages and novel features of the invention will become more apparent from the following detailed description of the present embodiment when taken in conjunction with the accompanying drawings.

DETAILED DESCRIPTION OF THE INVENTION

Figure 1:
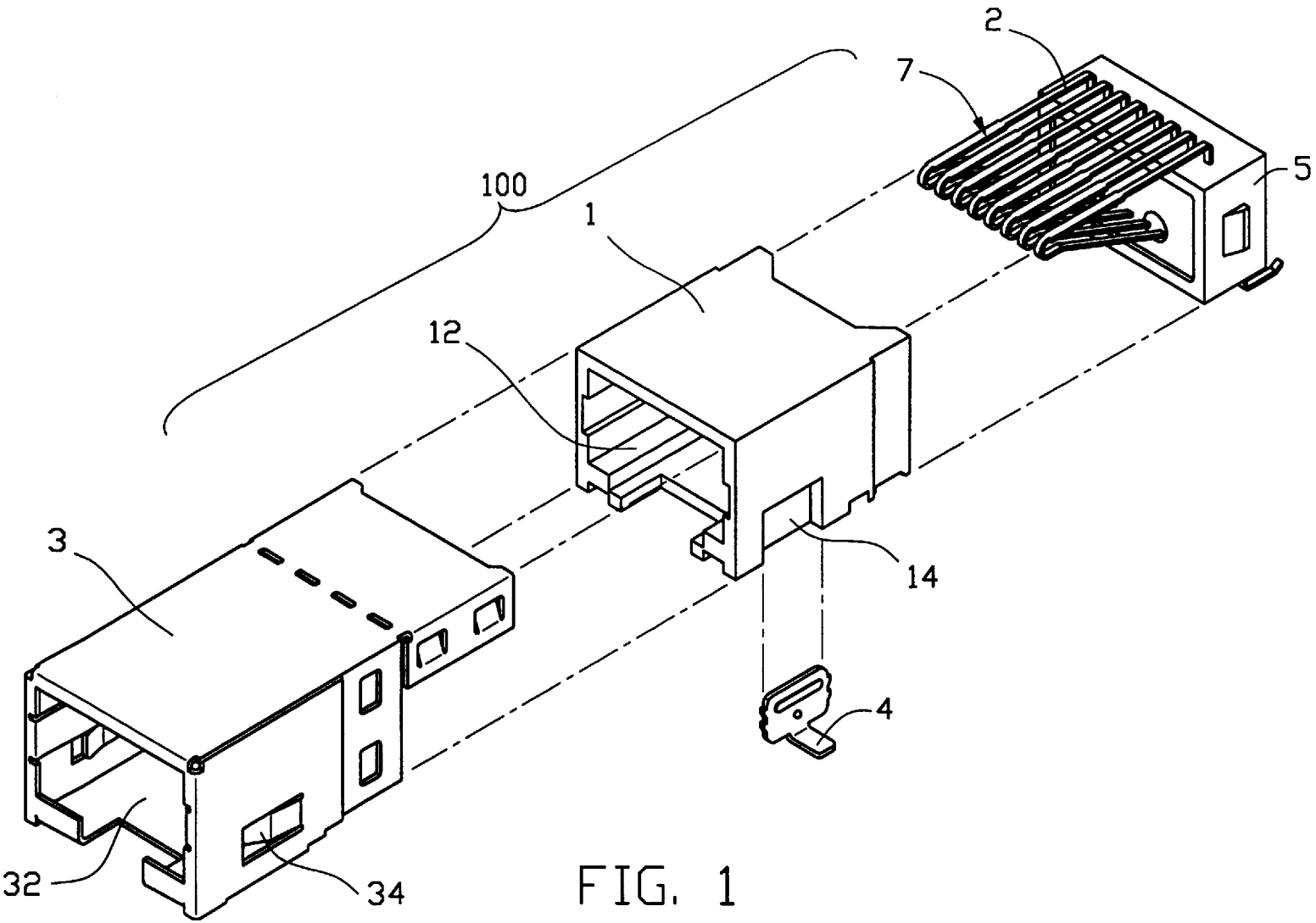
FIG. 1 is an exploded view of an electrical connector in accordance with the present invention.

Referring to FIG. 1, an electrical connector 100 in accordance with the present invention comprises an insulative housing 1, a plurality of terminals 2 received within the insulative housing 1, a shell 3 covering the insulative housing 1, a grounding plate 4 assembled in the insulative housing 1 for electrically connecting to a printed circuit board (not shown), and a spacer 5 wrapping about the terminals 2 by an insert-molded process.

Also referring to FIG. 1, the insulative housing 1 defines a receiving space 12 for receiving the terminals 2 and the spacer 5, and a pair of slots 14 formed on a lateral side (not labeled) thereof for receiving corresponding grounding plate 4 therein. The shell 3 defines a hollow space 32 for receiving the insulative housing 1. The shell 3 further includes a tab 34 on each lateral side thereof for electrically contacting the grounding plate 4 for transferring grounding signals to the printed circuit board.

Figure 2:
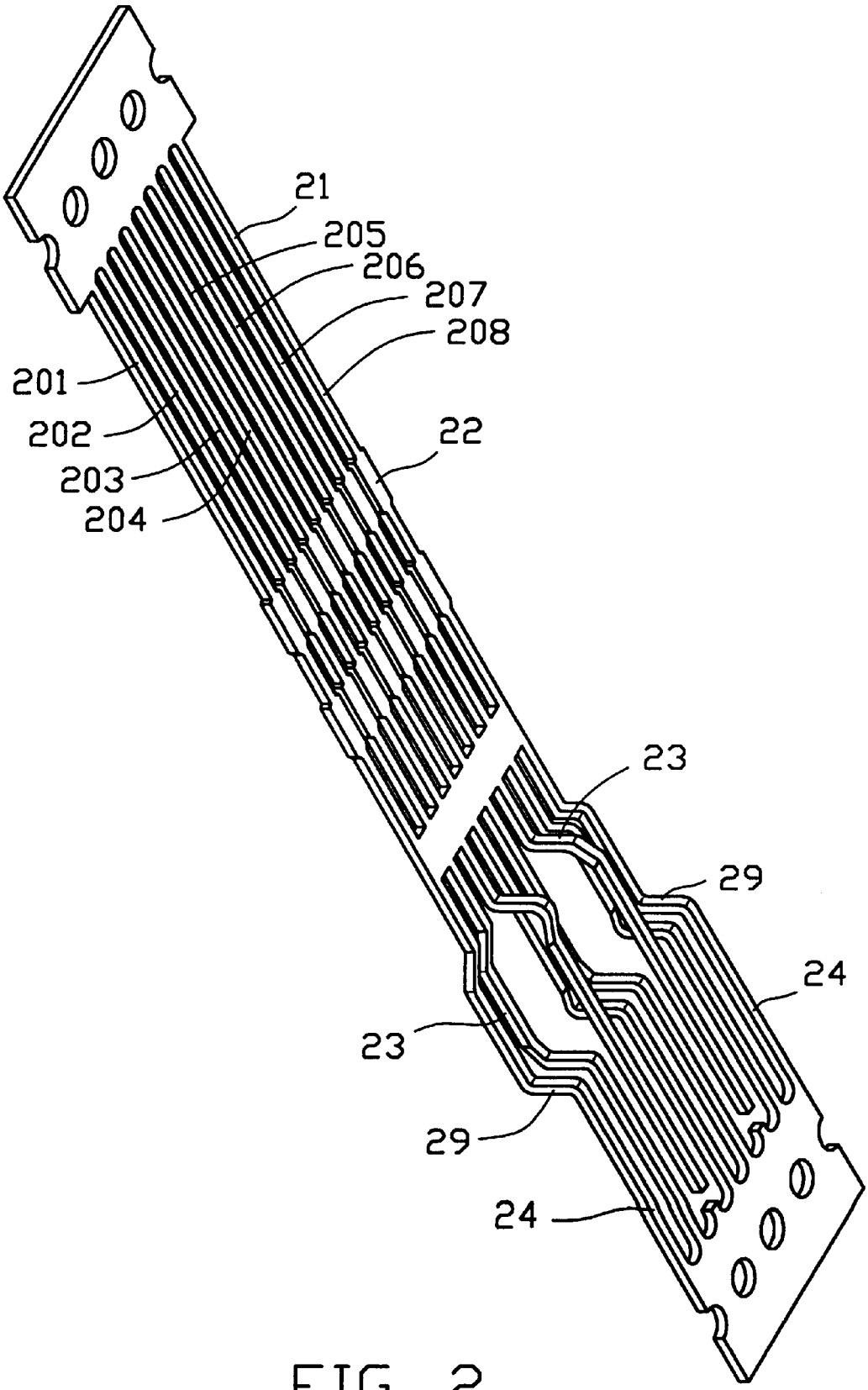
FIG. 2 is a perspective view of the terminals of FIG. 1 wherein the terminals are not fully bended.
Figure 3:
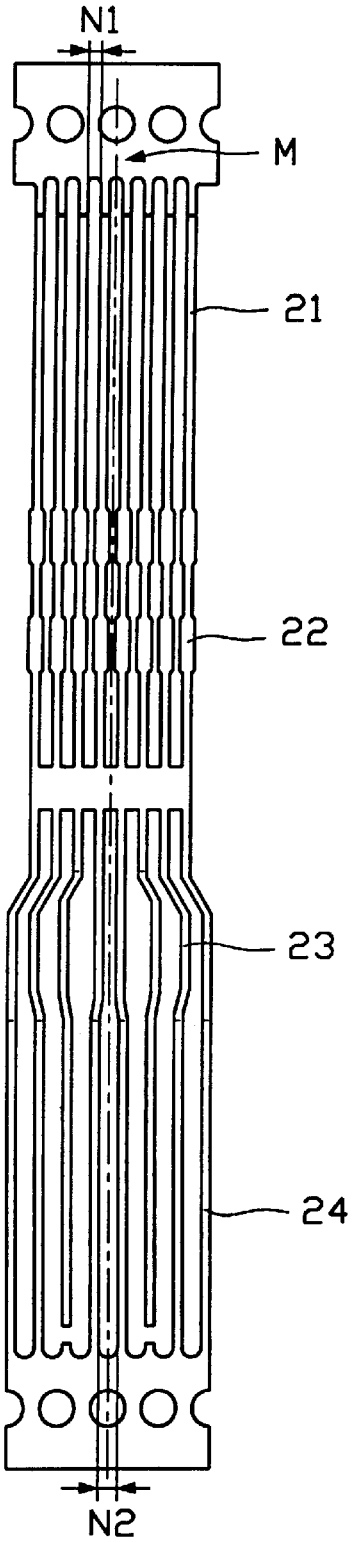
FIG. 3 is a top view of FIG. 2.
Figure 4:
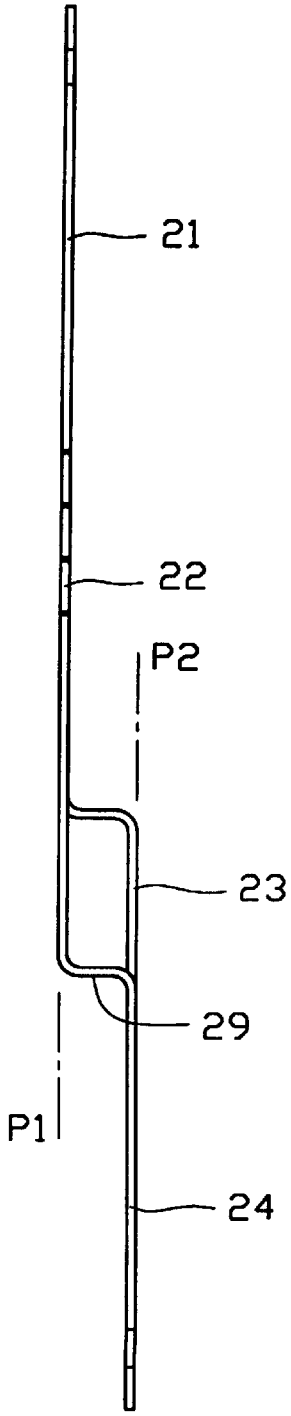
FIG. 4 is a side view of FIG. 2.

Referring to FIGS. 2 to 4, the terminals 2 are labeled from 201 (one) to 208 (eight). Each terminal 2 includes a contacting portion 21 at one end for engaging with a mating connector, a solder tail 24 at an opposite end for soldering to the printed circuit board, and a curving portion 23 extending between the contacting portion 21 and the solder tail 24. Each terminal 2 further includes an extending portion 22 between the contacting portion 21 and the curving portion 23 to ease the bending operation. Each two adjacent solder tails 24 are separated by a second distance N2 which is larger than a first distance N1 separating every two adjacent contacting portions 21 particularly referring to FIG. 4, the curving portions 23 of the third terminal 203 and the sixth terminal 206 are located at a second P2 while the curving portions 23 of the remaining six terminals 201, 202, 204, 205, 207, 208 are located at a first plane P1, wherein the first plane P1 is different from the second plane P2.

Particularly referring to FIG. 3, curving portions 23 of the first, second, third, sixth, seventh and eighth terminals 201, 202, 203, 206, 207,208 are bent laterally away from a middle line M. Such a design incorporating with the configuration that the curving portions 23 of the fourth and fifth terminals 204, 205 are located at a plane from that the curving portions 23 of the remaining terminals 201, 202, 203, 206, 207, 208 are located. A distance between the curving portions of the third and fourth terminals and between the curving portions of the fifth and sixth terminals is larger than a distance between any neighboring two of the curving portions of the remaining terminals.

Figure 5:
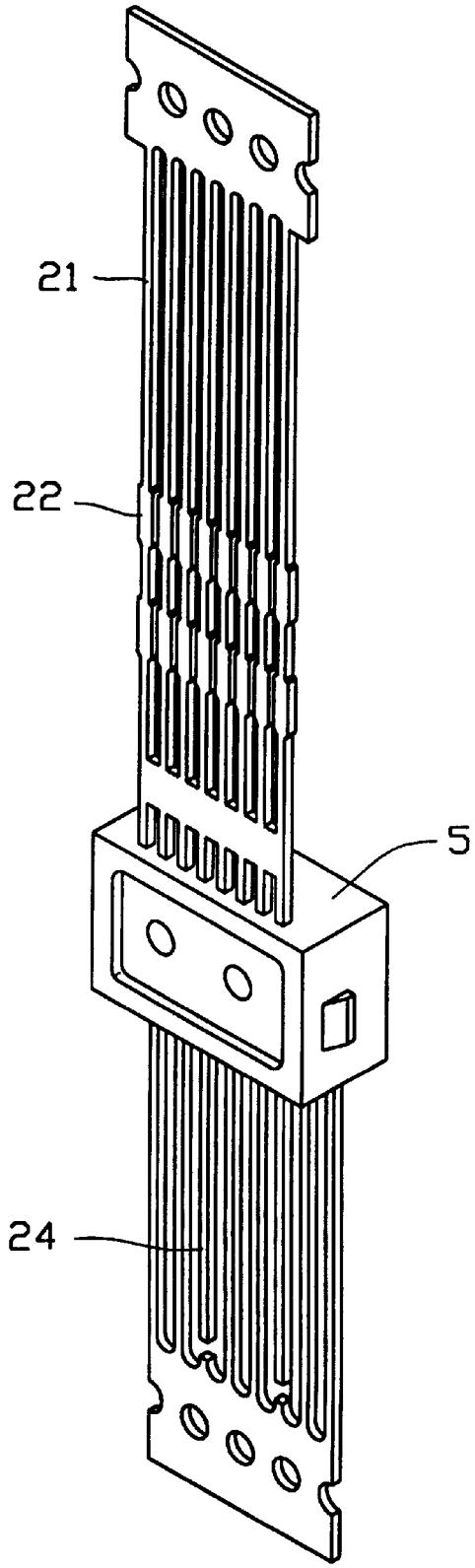
FIG. 5 is similar to FIG. 2 wherein the terminals are insert-molded in a spacer.
Figure 6:
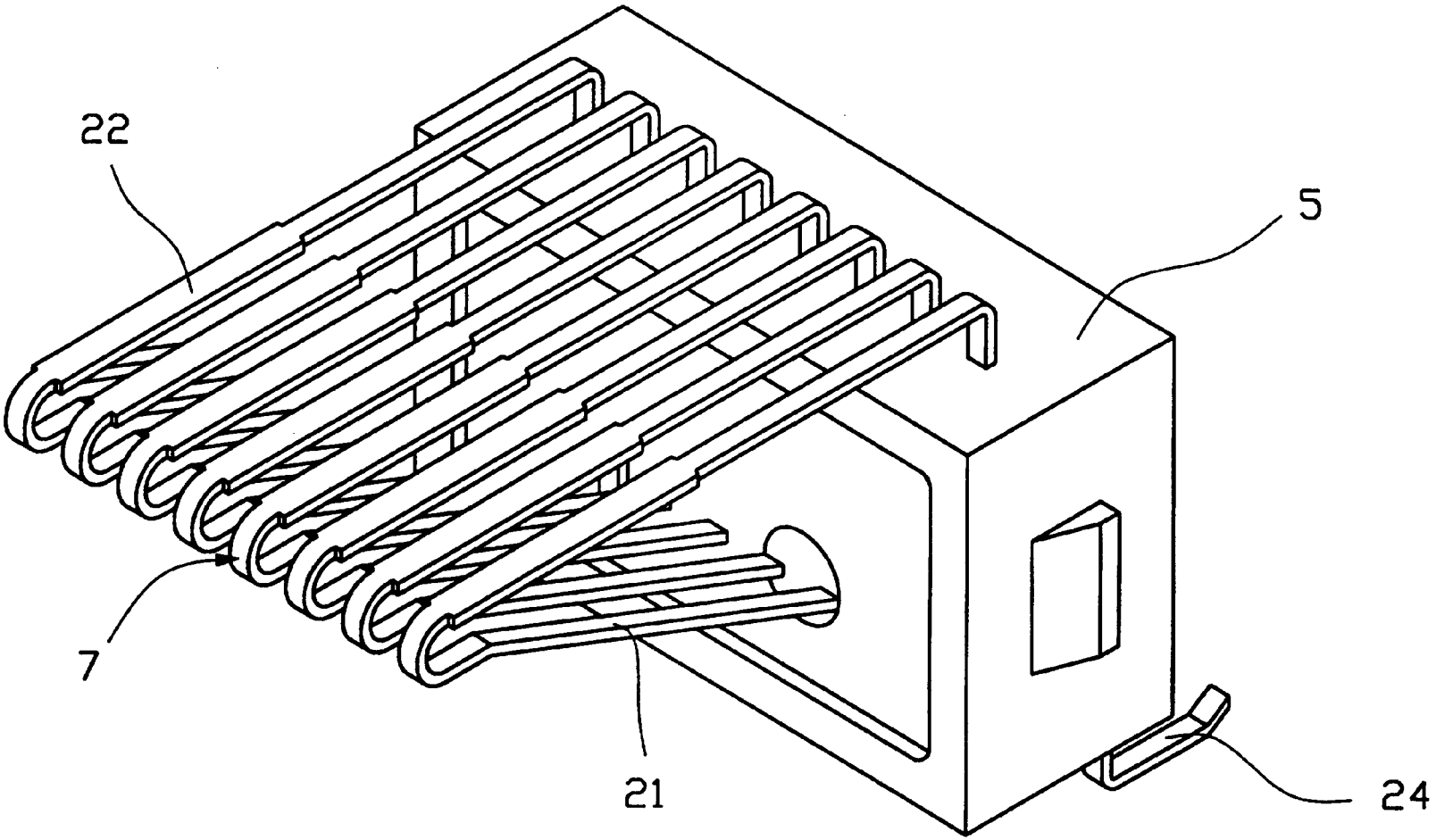
FIG. 6 is a perspective view of the terminal assembly of FIG. 1.
Figure 7:
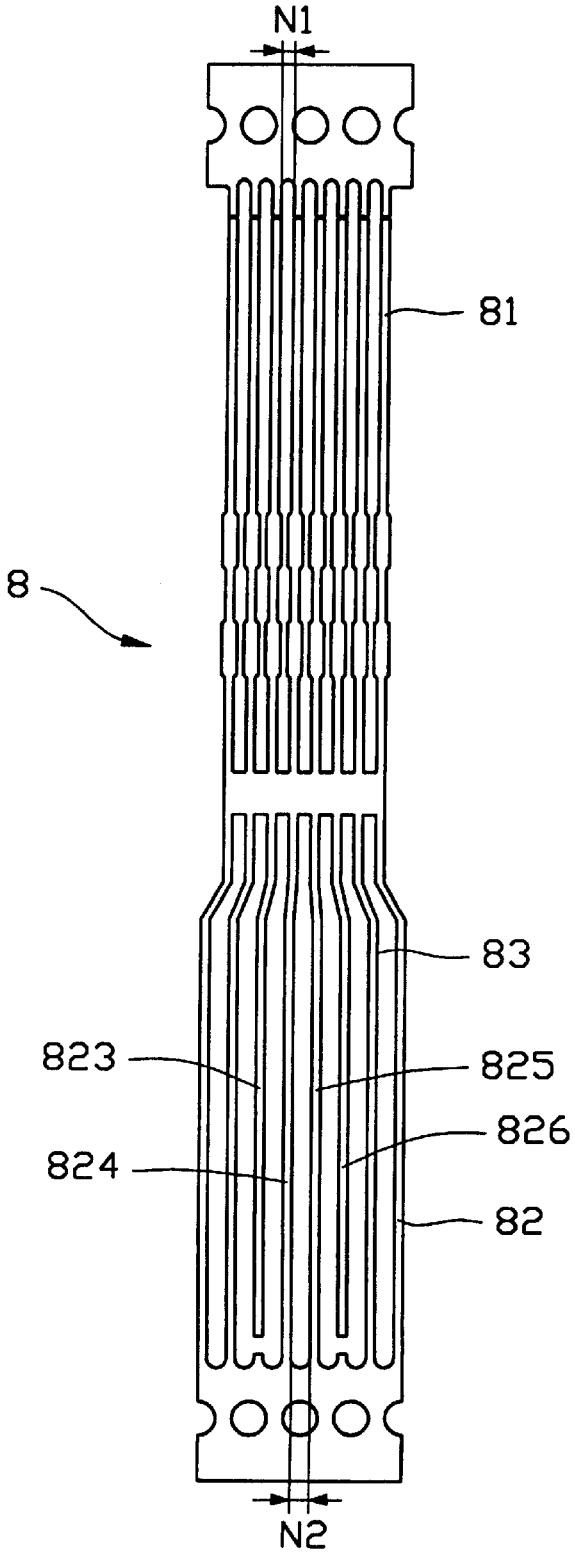
FIG. 7 (PRIOR ART)
FIG. 7 is a top view of prior art terminals before bending.
Figure 8:
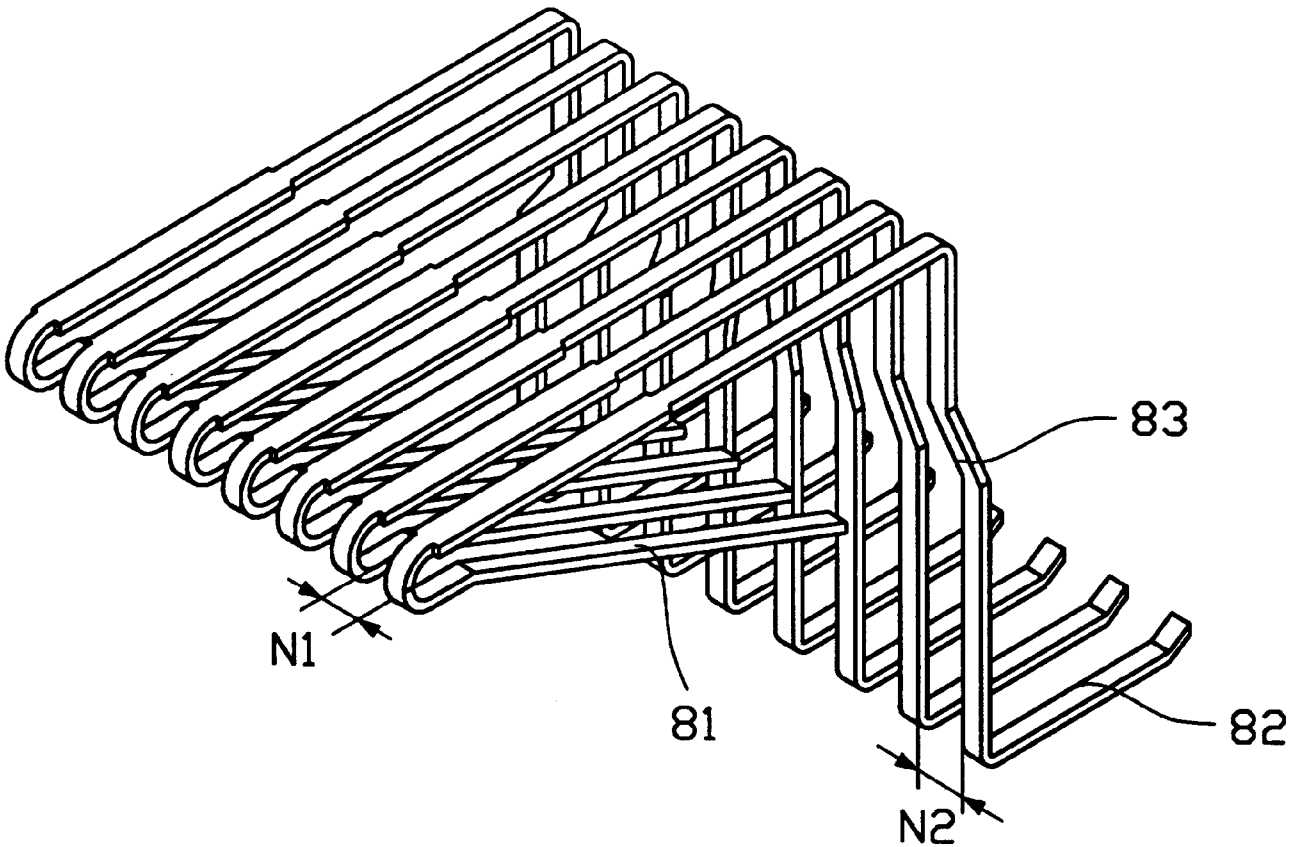
FIG. 8 (PRIOR ART)
FIG. 8 is a perspective view of the terminals of FIG. 7 in a bended state.

Referring to FIGS. 1, 5, and 6, in assembly, the grounding plate 4 are secured into corresponding slot 14 of the insulative housing 1. The curving portions 23 of the terminals 2 are insert-molded within the spacer 5 (FIG. 5), and are then bended to form a terminal assembly 7 as shown in FIG. 6. Referring to FIG. 1, the terminal assembly 7 is received in the receiving space 12 of the insulative housing 1. The insulative housing 1 is then securely assembled within the hollow space 32 of the shell 3, with the tab 34 of the shell 3 in electrical contact with the grounding plate 4. Finally the solder tails 24 and the solder pads 4 are soldered to the printed circuit board.

An advantage of the present invention is that the curving portions 23 of the third terminal 203 and the sixth terminal

206 protrude beyond the plane defined by the other curving portions 23, and the curving portions 23 of the fourth and fifth terminals 204, 205 laterally diverge within the plane, thereby increasing the distance between the curving portions 23 of the third and fourth terminals (203 and 204), and the fifth and sixth terminals (205 and 206), thereby diminishing cross-talk therebetween. It is also noted that other than the protruding curving portions 23 of the third terminal 203 and of the sixth terminal 206, the remaining terminals 201, 202, 204, 205, 207 and 208 further include protruding compensation sections 29 between the curving portions 23 and the solder tails 24 so that all the solder tails 24 are located in the same plane.

It is also seen that the third terminal 203 and the sixth terminal 206 are necessarily first severed from the contact carrier strip 28 when their curving portions 23 are formed to protrude above those of the remaining terminals. Surely, in a later time, the remaining terminals are also separated from the contact carrier strip 28 after their compensation sections 29 are formed between the curving portion 23 and the solder tails 24.

It can be understood that the invention provides a systematic and neat structure for arranging the rear portions of the terminals, and thus it is easy to manufacture the subject connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing defining a receiving space therein;

a plurality of terminals assembled in the receiving space, said terminals being successively labeled from one to eight, each terminal including a contacting portion at one end for engaging with a mating connector, a solder tail at an opposite end for soldering to a printed circuit board, and a curving portion extending between the contacting portion and the solder tail, every two adjacent solder tails being separated with a distance from each other which is larger than a second distance defined between two adjacent contacting portions;

wherein the curving portions of third and sixth terminals are located at a plane different from a plane at which curving portions of the remaining terminals are located, and wherein the curving portions of the first, second, third, sixth, seventh and eighth terminals are bent laterally away from a middle line of the terminals, a distance between the curving portions of the third and fourth terminals and between the curving portions of the fifth and sixth terminals is larger than a distance between any neighboring two of the curving portions of the remaining terminals.

2. The electrical connector as claimed in claim 1, wherein a plurality of extending portions is formed between the contacting portions and the curving portions to ease the bending operation.

3. An electrical connector connecting comprising:

an insulative housing;

a plurality of terminals disposes within the housing, said terminals being successively labeled from one to eight, each of said terminals including:

a contacting portion formed on a front portion of the terminal;

a solder tail formed on a rear portion of the terminal;

a curving portion positioned between the contacting portion and the solder tail;

a distance between the curving portions of third and fourth terminals and between the curving portions of fifth and sixth terminals is larger than a distance between the curving portions of any neighboring two of the curving portions of the remaining terminals; and a compensation section formed between the curving portion and the solder tail of each of the first, second, fourth, fifth, seventh and eighth terminals; wherein the compensation section extends perpendicular to both the curving portion and the solder tail of the corresponding terminal; wherein the solder tails of all the terminals are located in a plane; wherein the curving portions of the third terminal and the sixth terminal are located in said plane.

* * * * *